US005178332A

United States Patent [19]

Tsukakoshi et al.

[11] Patent Number: 5,178,332

[45] Date of Patent: Jan. 12, 1993

[54] FUEL INJECTION VALVE

[75] Inventors: Masayoshi Tsukakoshi; Hideo Kato, both of Isesaki, Japan

[73] Assignee: Japan Electronic Control Systems Co., Ltd., Isesaki, Japan

[21] Appl. No.: 809,340

[22] Filed: Dec. 18, 1991

[30] Foreign Application Priority Data

Dec. 19, 1990 [JP] Japan ..... 2-400969

[51] Int. Cl.[5] ..... F02M 51/08

[52] U.S. Cl. ..... 239/552; 239/585.3; 239/590.3; 29/890.143

[58] Field of Search ..... 239/585, 533.12, 590-590.5, 239/596, 601, 552, 562, 5, 1; 26/890.143, 888.01

[56] References Cited

U.S. PATENT DOCUMENTS

| | | | |
|---|---|---|---|
| 4,621,772 | 11/1986 | Blythe et al. | 239/585 |
| 4,646,974 | 3/1987 | Sofianek et al. | 239/585 |
| 4,890,794 | 1/1990 | Imafuku et al. | 239/533.12 |
| 4,923,169 | 5/1990 | Grieb et al. | 239/585 |
| 5,044,562 | 9/1991 | Rogers et al. | 239/596 |

FOREIGN PATENT DOCUMENTS

| | | |
|---|---|---|
| 0302637 | 2/1989 | European Pat. Off. . |
| 0348786 | 1/1990 | European Pat. Off. . |
| 8632002 | 5/1988 | Fed. Rep. of Germany . |
| 2399551 | 3/1979 | France . |
| 2436887 | 4/1980 | France . |
| 63-201365 | 8/1988 | Japan . |
| 1-249960 | 10/1989 | Japan . |
| 400836 | 11/1933 | United Kingdom . |

*Primary Examiner*—Andres Kashnikow
*Assistant Examiner*—Karen B. Merritt
*Attorney, Agent, or Firm*—Foley & Lardner

[57] ABSTRACT

A fuel injection valve has a flat injection hole plate arranged downstream of a valve seat on which a valve body is seated. A plurality of injection holes are formed through the injection hole plate in such a manner that the injection holes are inclined with respect to the axis of the valve body, to thereby increase the distance from the axis of the valve body in the downstream direction. The diameter of the injection hole is from 0.17 to 0.35 mm, and the chamfer dimension R at the inlet of the injection hole on the inlet side of the injection hole plate at the side close to the axis of the valve body, is greater than or equal to 0.1 mm. Accordingly, the flow reistance on the fuel flowing into the injection hole can be reduced, to thus prevent a vaporization of fuel due to a vacuum evaporation. With such a construction, even when the fuel injection valve is disposed in a vacuum box maintained in a vacuum atmosphere and an inspection for vacuum characteristics performed by injecting fuel, a variation of the flow rate can be maintained with good characteristics under a small flow rate variation rate and therefore, the production yield of the fuel injection valve can be improved.

5 Claims, 3 Drawing Sheets

FUEL INJECTION VALVE

BACKGROUND OF THE INVENTION (1) Field of the Invention

The present invention relates to an electromagnetic type fuel injection valve, such as a fuel injection valve for injecting fuel into an induction system of an engine in an electronically controlled fuel injection system for an internal combustion engine, more particularly, to a construction of an injection hole.

(2) Related Art of the Invention

As a fuel injection valve to be used in an electronically controlled fuel injection system for an internal combustion engine, there is known a fuel injection valve having a valve body lifted by an electromagnet and a flat injection hole plate formed with a plurality of injection holes and provided downstream of a valve seat, for seating the valve body. Each of the injection holes is arranged concentrically in the injection hole plate and is inclined with respect to the axis of the valve body such that the distance from the axis is increased in the downstream direction.

In the open position, the fuel flowing through the lifted valve body and the valve seat is discharged with a wide angle with respect to the axis through the respective injection holes of the injection hole plate, to be thus dispersed (see Japanese Unexamined Patent Publication Kokai) 1-249960).

In such a type of fuel injection valve, the static flow rate adjustment of the fuel injection valve is performed by machining and honing the injection holes.

Furthermore, such a type of the fuel injection valve is positioned in the air intake passage downstream of a throttle valve, and a vacuum characteristics inspection when checking injection characteristics is performed by performing an injection through the fuel injection valve into a vacuum box maintained at a vacuum of −500 mm Hg by, for example, a vacuum pump.

Nevertheless, if the conditions associated with the honing process are not determined in consideration of the influence of the configuration of the inlet of the injection hole for the vacuum characteristics, a substantial flow resistance is induced at the inlet edge of the injection hole and causes a vaporization of the fuel due to a vacuum evaporation at the edge portion. This increases the possibility that the fuel injection valve does not meet standard, and a lowering of production yield.

SUMMARY OF THE INVENTION

An object of the present invention is to eliminate an occurrence of a vaporization of fuel due to a vacuum evaporation at an inlet portion of an injection hole in a fuel injection valve.

Another object of the invention is to maintain good vacuum characteristics of the fuel injection valve.

A further object of the invention is to prevent a lowering of a production yield of the fuel injection valve.

To achieve the above objects, a fuel injection valve according to the present invention has a flat injection hole plate arranged downstream of a valve seat, on which a valve body to be lifted by an electromagnet is seated, a plurality of injection holes being formed through the injection hole plate in such a manner that the injection holes are inclined with respect to the axis of the valve body, to thus increase the distance from the axis of the valve body in the downstream direction, wherein the diameter of the injection hole is from 0.17 to 0.35 mm. and the chamfer dimension R at the inlet of the injection hole on the inlet side of the injection hole plate at the side close to the axis of the valve body is greater than or equal to 0.1 mm.

Also, a method of forming the injection hole in the fuel injection valve, according to the present invention, comprises the step of providing a chamfer having a dimension R greater than or equal to 0.1 mm for the inlet of the injection hole plate, after forming a hole having a diameter from 0.17 to 0.35 mm.

With the fuel injection valve having the construction set forth above, and formed by the process set forth above, the following results can be obtained through a vacuum characteristics inspection of a fuel injection by disposing the fuel injection valve within a vacuum box maintained in a vacuum.

When the valve body is lifted upon valve opening, the fuel flows between the valve body and the valve seat with a high flow velocity. Where the injection holes have a diameter from 0.17 to 0.35 mm, due to a flow resistance acting upon the flow of the fuel into the injection hole, a vaporization of the fuel due to vacuum evaporation is easily established at a side close to the axis of the valve body of the injection holes of the inlet portion of the injection hole plate, where the flow resistance is greater. Nevertheless, by providing a chamfer dimension R greater than or equal to 0.1 mm at the injection hole at the inlet of the injection hole plate, the flow resistance on the fuel flowing into the injection hole can be significantly reduced, and thus a vacuum evaporation can be suppressed at the side close to the axis of the valve body in the inlet of the injection hole plate, which contributes to a stabilization of the vacuum flow rate characteristics.

Further, where a disc shape plate as the fuel injection valve is employed for the small fuel injection valves, since such a plate is light weight, desired response characteristics can be satisfied.

Furthermore, the present invention is particularly effective in correspondence with intake vacuum characteristics present when the fuel injection valve is installed with the injection holes directed in the downstream direction of a throttle valve of the internal combustion engine.

A chamfer dimension R greater than or equal to 0.1 mm can be provided by honing for a time longer than or equal to 30 seconds.

The object of the present invention will be made clear from the following discussion of the preferred embodiment, with reference to the accompanying drawings.

EMBODIMENT

Figure 1:
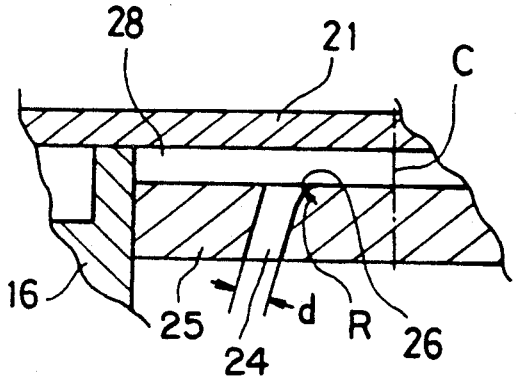
FIG. 1 is a section view of the major part of one embodiment of a fuel injection valve according to the invention.
Figure 2A:
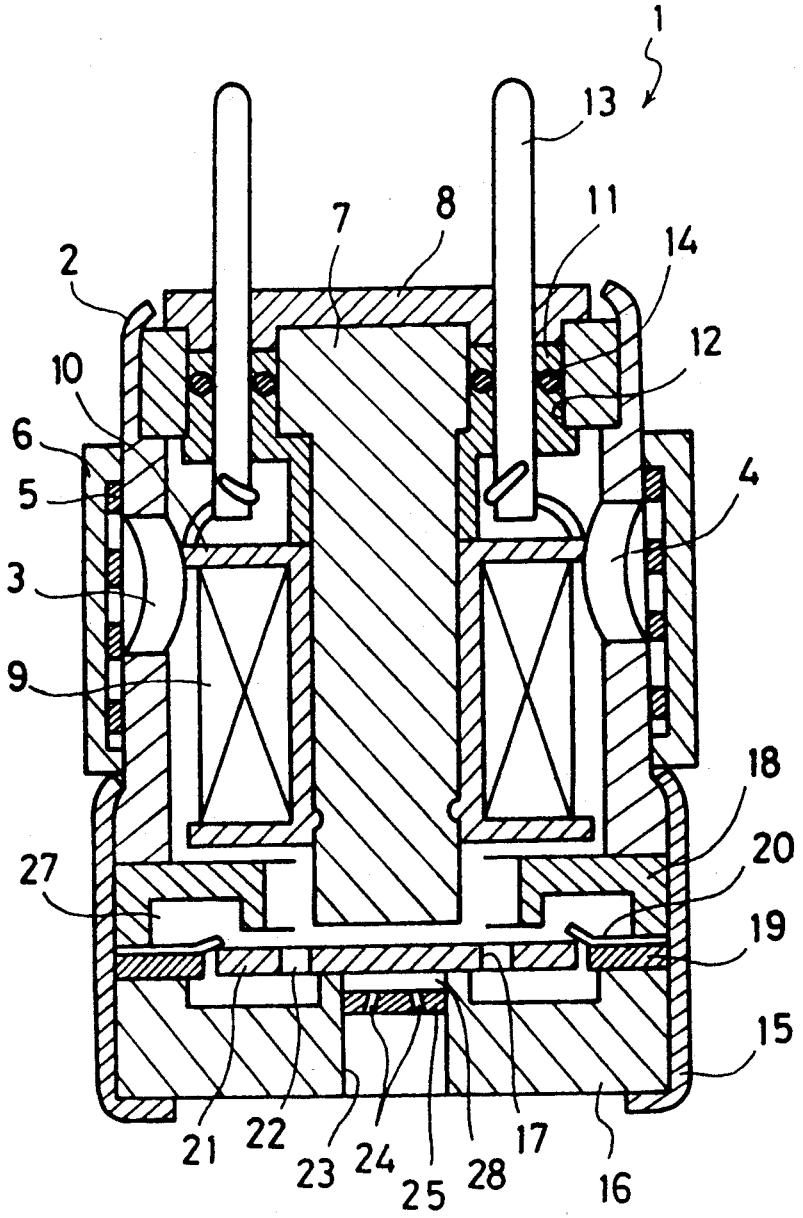
FIGS. 2A and 2B are section views showing an overall construction of the fuel injection valve.
Figure 2B:
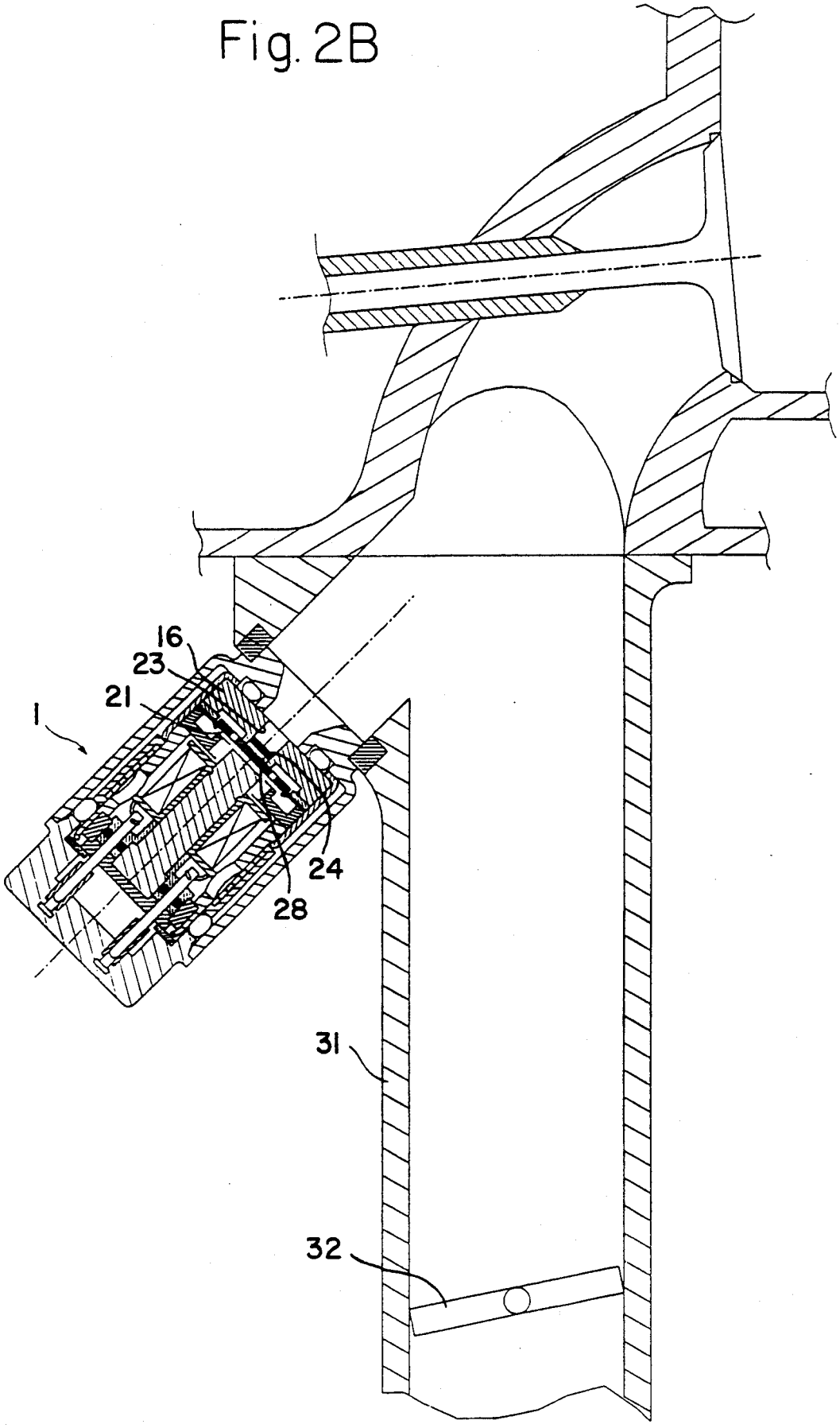

Referring to FIGS. 1, 2A and 2B, a fuel injection valve 1 is arranged within an air intake passage 31 downstream of a throttle valve 32 of an internal combustion engine. The fuel injection valve 1 has a cylindrical housing 2 having a fuel inlet 3 and a fuel outlet 4 formed through the side wall. The fuel inlet 3 and the fuel outlet 4 are connected to a fuel piping 6 through an annular fuel filter 5.

At the center of the inside of the housing 2, there is provided a solid core 7 made of iron, for example. The core 7 is fixed in place by contact with a cover 8 covering the upper end opening of the housing 2.

On the outer periphery of the core 7, a coil bobbin 10 made by resin molding and on which an electromagnetic coil 9 is wound, is mounted. A pair of terminal holding sections 11 are inserted into terminal connection openings 12 to extend a pair of terminals 13 out of the housing 2. An O ring is provided between the pair of terminals 13 and the core 7, to prevent fuel leaking therethrough.

On the tip end of the housing 2, a valve seat 16 is fitted via a holder 15. At the center portion of the valve seat 16, an annular valve seat portion 17 is formed in opposition to the bottom of the core 7.

Furthermore, between the holder 15 and the outer circumferential of the valve seat 16, a lift adjusting member 18 and a shim 19 with an annular leaf spring 20 disposed therebetween are provided. With the inner circumferential edge of the leaf spring 20, a disc shaped valve body 21 is urged toward the valve seat portion 17. The valve body 21 is made of a magnetically conductive material. The valve body is formed of a plurality of cut out openings 22 arranged concentrically on a circle greater than the external diameter of the core 7 and the valve seat portion 17. In the deenergized condition of the electromagnetic coil 9, the valve body 21 is seated on the valve seat portion 17 by the biasing force of the leaf spring 20, and thus maintained in a valve closed condition.

In a hole 23 formed at the center portion of the valve seat 16 is provided a flat injection hole plate 25 having a plurality of (e.g., five) injection holes 24 arranged essentially concentrically with respect to the center axis C of the valve body.

Each of the injection holes 24 has a diameter d from 0.17 to 0.35 mm corresponding to the set fuel flow quantities 150–400 cc/min. and is directed so that the distance to the center axis C of the valve body 21 is increased in the downstream direction. Furthermore, a chamfer is provided having a dimension R greater than or equal to 0.1 mm on the injection hole 24 at the inlet portion of the injection hole plate 25, at the side close to the center axis C. The chamfer of the injection hole 24 at the inlet portion of the injection hole plate 25, at the side close to the center axis C, is formed by a honing process. By controlling a processing tune for performing the honing, it becomes possible to obtain a predetermined chamfer dimension R. In the above-mentioned case, by setting the process tune for honing to 30 seconds, a chamfer dimension R greater than or equal to 0.1 mm can be obtained.

In the fuel injection valve constructed as set forth above, the fuel is introduced into the housing 2 through the fuel inlet 3 and accumulated within a high pressure chamber 27 defined upstream of the valve seat portion 17. At the valve opening, the electromagnetic drawing force is exerted on the core 7 by the electromagnetic coil 9, to draw the valve body 21 upward in the drawing until the latter comes into contact with the bottom of the lift adjusting member 18, so that the valve body 21 is lifted away from the valve seat 16. Then, the fuel within the high pressure chamber 27 flows into a valve seat chamber 28 defined between the valve body 21 and the injection hole plate 25 and is injected into the air intake passage 31 of the internal combustion engine through the injection holes 24. The excess amount of fuel is returned from the fuel output to a fuel tank through a pressure regulator (not shown). Accordingly, the fuel pressure in the high pressure chamber 27 is maintained constant.

Next, the effect of setting of the diameter d of the injection hole 24 to within 0.17 to 0.35 mm and setting the chamfer dimension R to be greater than or equal to 0.1 mm will be discussed with reference to FIG. 3.

Figure 3:
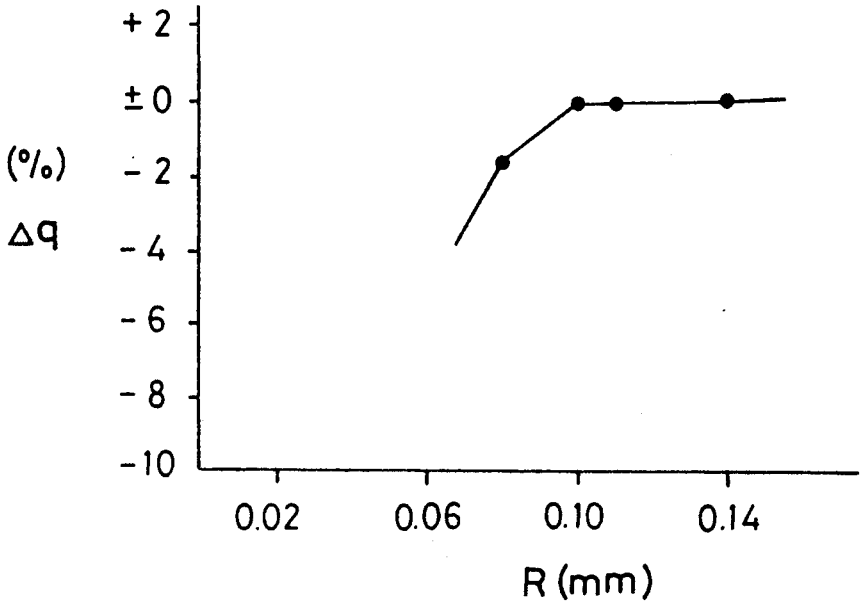
FIG. 3 is an explanatory illustration showing an operation of the embodiment.

In FIG. 3 the horizontal axis shows the chamfer dimension R at the side 26 of the center axis of the inlet portion, and the vertical axis shows a plot of variation rate $\Delta q$ of injection characteristics when the injection hole 24 of the fuel injection valve 1 is directed to the interior of the vacuum box, which is maintained at a vacuum pressure of $-500$ mmHg, and a fuel injection is performed through the fuel injection valve. As shown in FIG. 3, when the diameter of the injection hole 24 is within 0.17 to 0.35 mm, if the chamfer dimension R is smaller than 0.1 mm, a significant variation of a vacuum characteristics occurs. Conversely, when the chamfer dimension R is set to be greater than or equal to 0.1 mm, no vacuum characteristics variation occurs. It is believed that, by setting the chamfer dimension R to be greater than or equal to 0.1 mm, the flow resistance on the fuel entering into the injection hole 24 can be significantly reduced, and therefore, a vacuum evaporation at the side 26 of the center axis of the inlet of the injection hole plate 25 is successfully prevented, to thus stabilize the vacuum characteristics.

Accordingly, it becomes possible to avoid a non-standardization of the fuel injection valves 1, due to the stable vacuum characteristics, and thus avoid a degradation of the production yield.

It should be noted that the discussion above has been made for the shown embodiment of the fuel injection valve provided with the flat injection hole plate 25 with a plurality of the injection holes 24, disposed at the center portion of the valve seat, but the invention is equally applicable to a construction in which the valve seat and the injection hole plate are formed integrally. Furthermore, the number of the injection holes 24 is not limited to five and can be any number.

As set forth above, according to the present invention, when high velocity fuel flows through the injection hole having a diameter from 0.17 to 0.35 mm, since the chamfer dimension R is set to be greater than or equal to 0.1 mm, the flow resistance on the fuel flowing into the injection hole can be remarkably reduced, to thus effectively prevent a vacuum evaporation at the hole plate, and thereby contribute to an improvement of the production yield.

What is claimed is:

1. A fuel injection valve comprising:

a valve body to be lifted by an electromagnet;

a flat injection hole plate arranged downstream of a valve seat, on which said valve body is seated, and being formed with a plurality of injection holes therethrough in such a manner that said injection holes are oblique with respect to the axis of said valve body to increase the distance from the axis of said valve body toward downstream, each said injection hole having a diameter in a range of 0.17 to 0.35 mm, and a chamfer dimension R at the inlet of each said injection hole on the inlet side of said injection hole plate at the side closest to the axis of said valve body, being at least 0.1 mm.

2. A fuel injection valve as set forth in claim 1, wherein said valve body is formed into a disc shaped configuration.

3. A fuel injection valve as set forth in claim 1, wherein said injection valve is installed in an intake passage and said injection hole faces to the downstream side of a throttle valve of the internal combustion engine.

4. A method for forming an injection hole in a fuel injection valve comprising the steps of:

for a flat injection hole plate arranged downstream of a valve seat, on which a valve body to be lifted by an electromagnet is seated, forming a plurality of injection holes each having a diameter in a range of 0.17 to 0.35 mm in such a manner that said injection holes are oblique with respect to the axis of said valve body to increase the distance from the axis of said valve body toward downstream, and providing a chamfer with a dimension R being at least 0.1 mm at the inlet of each said injection hole on the inlet side of said injection hole plate.

5. A method for forming an injection hole of a fuel injection valve as set forth in claim 4, wherein said providing a chamfer is performed by a honing process performed for a period of at least 30 seconds.

* * * * *